US005584343A

United States Patent [19]

Coone

[11] Patent Number: 5,584,343

[45] Date of Patent: Dec. 17, 1996

[54] METHOD AND APPARATUS FOR FILLING AND CIRCULATING FLUID IN A WELLBORE DURING CASING RUNNING OPERATIONS

[75] Inventor: Malcolm G. Coone, Katy, Tex.

[73] Assignee: Davis-Lynch, Inc., Pearland, Tex.

[21] Appl. No.: 433,253

[22] Filed: Apr. 28, 1995

[51] Int. Cl.[6] ..... E21B 33/124; E21B 33/127

[52] U.S. Cl. ..... 166/387; 166/187

[58] Field of Search ..... 166/379, 387, 166/85.3, 85.5, 84.4, 90.1, 187, 188

[56] References Cited

U.S. PATENT DOCUMENTS

| | | | |
|---|---|---|---|
| 4,655,286 | 4/1987 | Wood | 166/285 |
| 4,817,724 | 4/1989 | Funderburg, Jr. et al. | 166/337 |
| 4,869,324 | 9/1989 | Holder | 166/187 X |
| 5,024,273 | 6/1991 | Coone et al. | 166/187 X |
| 5,044,444 | 9/1991 | Coronado | 166/187 X |
| 5,186,258 | 2/1993 | Wood et al. | 166/387 |

*Primary Examiner*—Frank Tsay
*Attorney, Agent, or Firm*—Matthews and Associates, L.L.P.

[57] ABSTRACT

A method and apparths for filling and circulating drilling fluid in a wellbore during casing running operations is disclosed. A fill/circulate tool is placed partially within the upper end of a casing string so that fluid may be pumped into the interior of the casing string. The tool has a self energizing seal element which engages the interior wall of the casing string when the tool is fully lowered therein, said seal element being energized by the pressure of the fluid in the casing string so that fluid pumped into the casing string through the tool is circulated through the casing string and explled from the lower end of the casing string.

7 Claims, 3 Drawing Sheets

METHOD AND APPARATUS FOR FILLING AND CIRCULATING FLUID IN A WELLBORE DURING CASING RUNNING OPERATIONS

FIELD OF THE INVENTION

The invention relates generally to the drilling of subterranean wells and more specifically to filling and circulating drilling fluid through a casing string to facilitate the lowering of casing to a desired depth while using top-drive drilling systems.

BACKGROUND

When subterranean wells such as oil wells are drilled, one of the necessities of drilling operations is the maintenance of drilling fluid in the casing pipe (or casing string). This fluid is necessary because, for example, the pressure of the formation and fluid surrounding the casing string may cause the wellbore to collapse if this pressure is not counterbalanced. Drilling fluid is therefore placed in the wellbore to provide fluid pressure directed outward against the potential collapsing pressure of the formation. When running (lowering) casing, drilling fluid is transported to the casing string and placed therein by a filling tool (the most basic of which is a simple hose).

Drilling fluid is also used to enhance actual casing running operations. For instance, when a wellbore casing is lowered into a wellbore, cuttings or pieces of the formation may cause bridging or otherwise get in the way of the casing so that it is prevented from being lowered into the wellbore. Drilling fluid is then circulated from the top of the casing, through and out the lower end of the casing so that the particles at the lower end, which had been impeding the progress of the casing, are washed outward, away from the end of the casing. This is accomplished through the use of a circulation tool.

Filling and circulation tools can be combined in multipurpose tools. Two such tools are known in the art. Frank's Casing Crew & Rental Tools, Inc. produces a tool referred to as the Hi Top Model FC-1 Fill-Up Circulation Tool. This tool utilizes a filling tool with a inverted cup seal mounted on the tool. The cup seal is significantly larger than the inner diameter of the casing so that a tight seal can be achieved. The drawbacks of this tool include the high forces required to insert the oversized seal into the casing, the excessive wear on the seal resulting from the force used to insert the seal (especially through threads, adapter connections, etc.). Also, several sizes of cup seals must be kept in inventory for a given size of casing because each size of casing may have a number of different weights and correspondingly different inner diameters.

TAM International, Inc. has developed a fill and circulation tool which utilizes an inflatable packer to seal the casing end for circulation operations. This tool has a mandrel through which drilling fluid is pumped. The fluid exits the mandrel just above a guide nose on the bottom of the tool. The inflatable packer of the tool encircles the mandrel and slides up and down the mandrel. During filling operations, the packer is manually latched into position above the circulation ports so that fluid drains out of the tool. In order to accomplish circulation operations, the latch of the packer is manually released and the packer drops into a position which covers the circulation ports, thus directing fluid into the packer and inflating it. After the packer is inflated so that it seals the casing end, the mandrel is moved downward so that the circulating ports direct fluid into the interior of the casing and the fluid circulates through the casing. The disadvantages of this tool include the danger of having to manually release the latch so that the packer will inflate, the time required to raise and lower the tool for changing from filling to circulating operations, the number of moving parts of the tool, and the cost of replacing and/or repairing the tool.

An external-seal circulating head is also available from LaFleur Petroleum Services, Inc. This tool utilizes a bell-shaped body which is placed over the end of the casing string. Several o-ring shaped seals are located between the body and the external surface of the casing to seal the connection. This tool does not appear to be widely used.

SUMMARY OF THE INVENTION

The invention improves upon the prior art by providing a filling tool with a self-energizing sealing element which simplifies changes from filling to circulating operations, which is easily inserted into a casing string, which has very few moving parts, which is very durable, which is easy to repair, which is safe to use and which does not require special preparation of the casing prior to use.

The invention provides these features by incorporating a sealing section into a filling tool. The invention is partially inserted into the casing (so that the filling/circulating ports are within the casing, but the sealing section is not) during filling operations. To achieve circulation within the casing, the tool is simply lowered fully into the casing. The sealing section has a generally torroidal (donut-shaped) sealing element in an assembly which is friction-fit within the casing, but which also allows the pressure developed during circulating operations to urge the sealing element outward against the casing. The seal element thereby is automatically urged outward when circulation is initiated.

DETAILED DESCRIPTION OF THE PREFERRED EMBODIMENT

I. Construction

Figure 1:
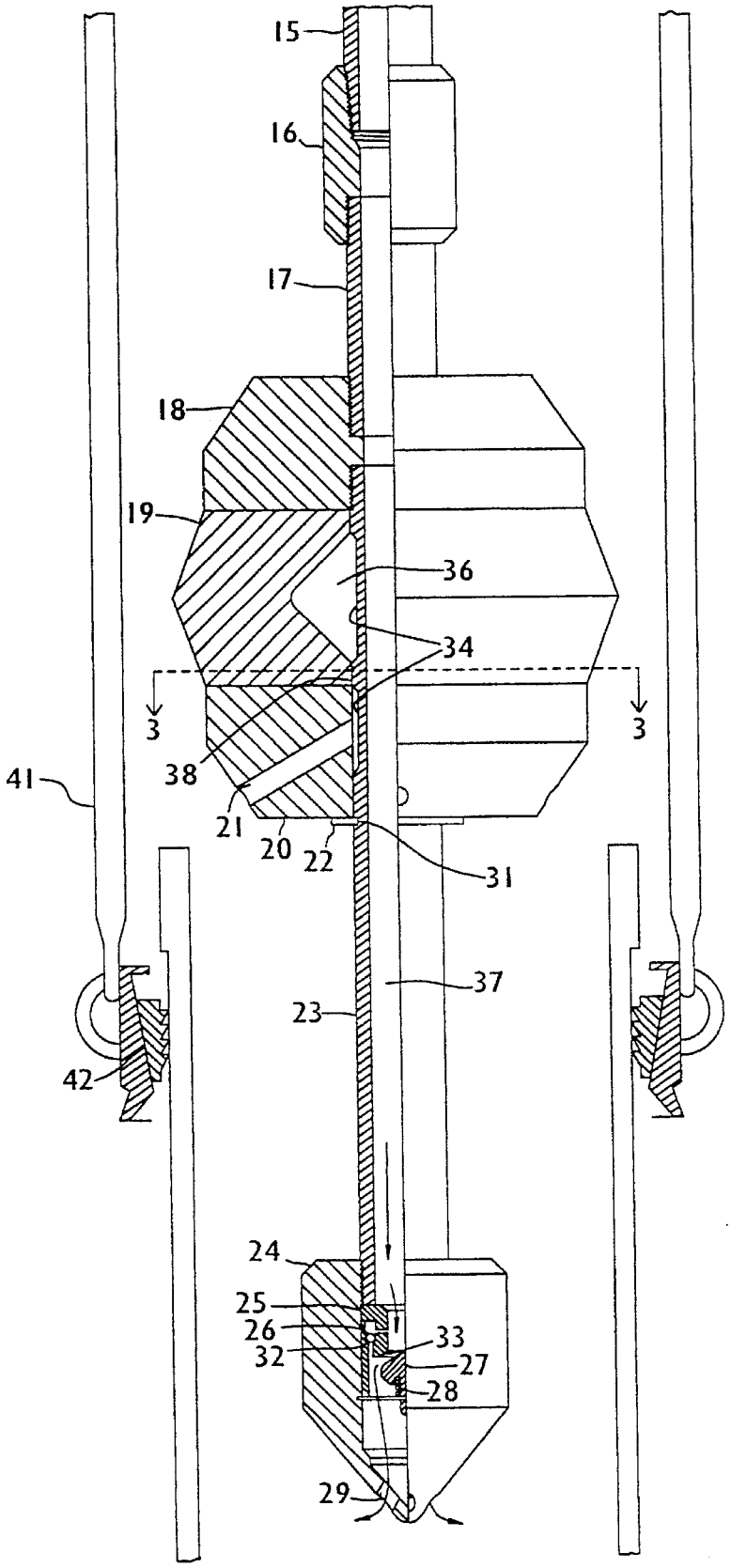
FIG. 1 is a side view of the invention in partial cross section, with the invention in position for filling operations.
Figure 2:
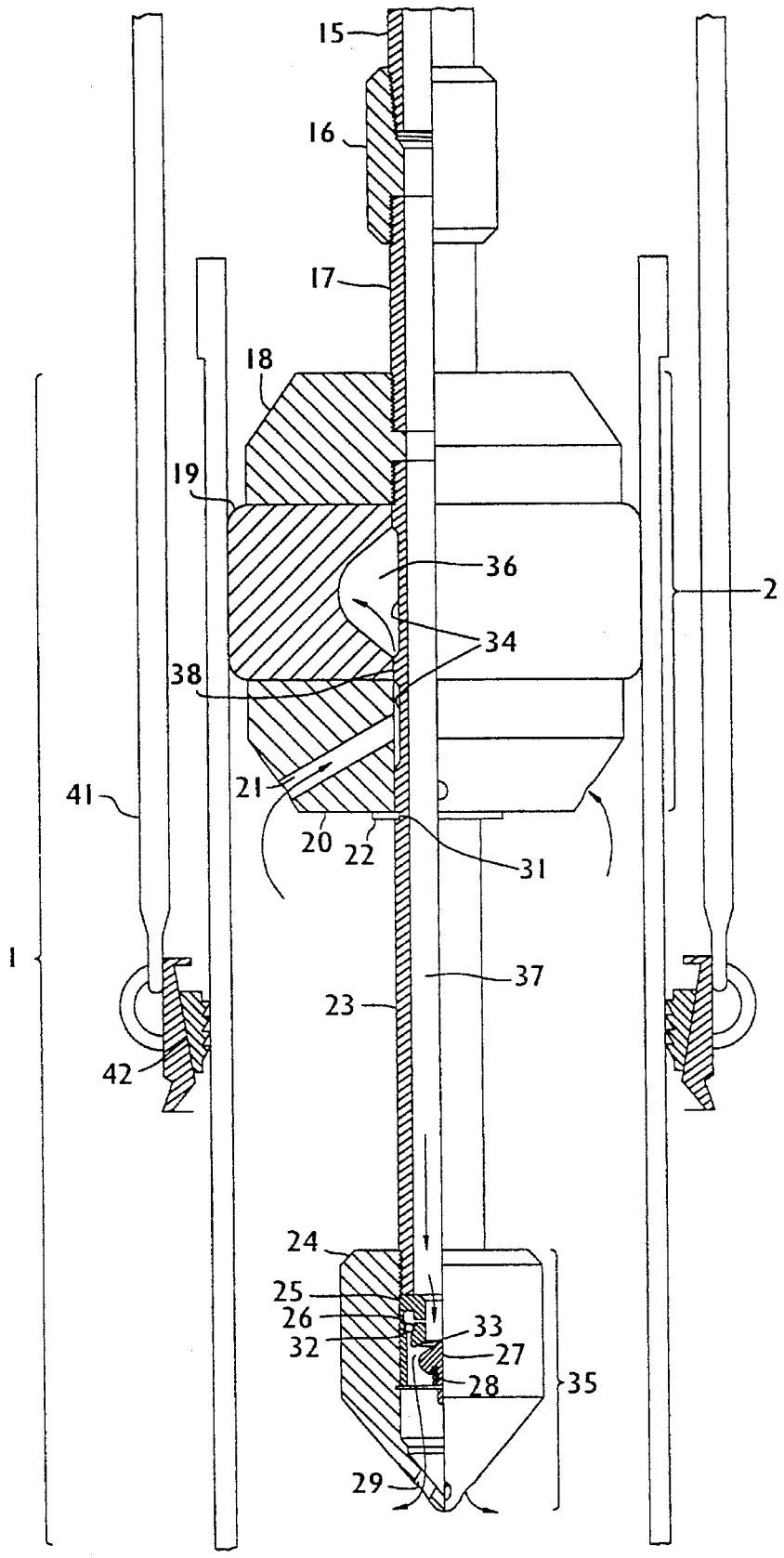
FIG. 2 is a side view of the invention in partial cross section, with the invention in position for circulating operations.

Referring to FIGS. 1 and 2, the preferred embodiment of the invention generally comprises a filling tool section (1) which has a sealing section (2) attached thereto. The filling tool section comprises lower mandrel (23) and valve sub (35). Sealing section (2) is formed by placing the self-energized sealing element (19) between mandrel connector sub (18) and ported guide sub (20). These parts are held in position by threadedly attaching the top end of the lower mandrel (23) to the mandrel connector sub (18) and securing the ported guide sub by placing retainer ring (22) around the lower mandrel at notch (31).

Figure 3:
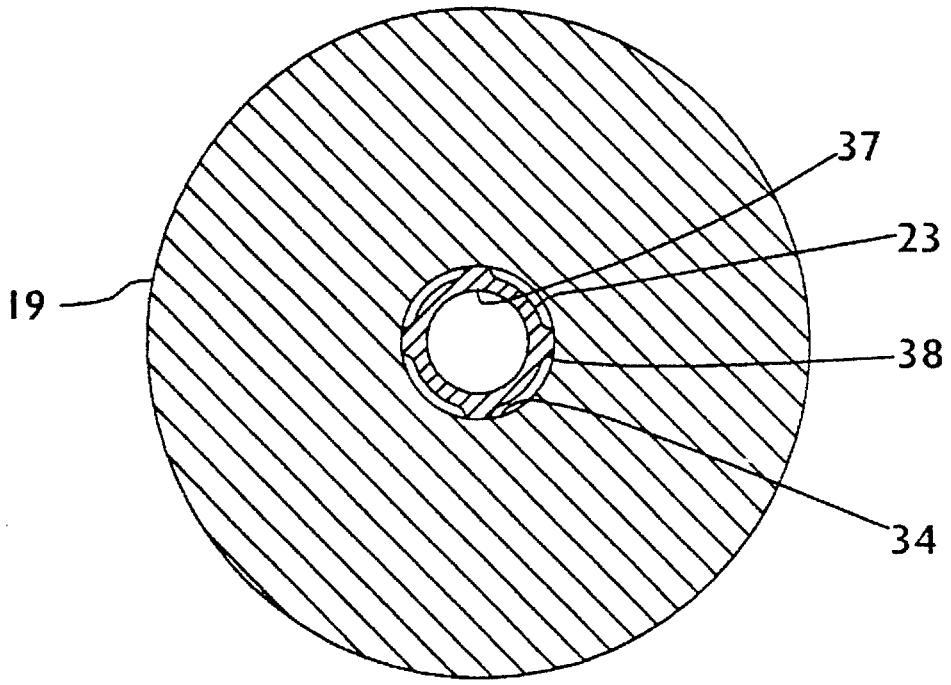
FIG. 3 is a top, cross sectional view of a preferred embodiment along the line 3—3 of FIG. 1.

Sealing element (19) is made of an elastomeric material such as rubber, and is shaped such that a cavity (36) is formed between the sealing element and the lower mandrel (23). Ported guide sub (20) has ports (21) extending from its outer surface to its inner surface, which is partially in contact with lower mandrel (23 Lower mandrel (23) further has recesses (34) which adjoin cavity (36) and ports (21). These features of the preferred embodiment are also shown in FIG. 3. The assembled sealing section thus contains a passageway extending from the outer face of the ported guide sub (20) to the cavity (36) between the lower mandrel (23) and the sealing element (19) so that fluid pressure at the ported guide sub is transmitted to the inner face of the sealing element at cavity (36). Although the cavity (36) of the preferred embodiment is formed by the generally concave inner face of the sealing element (19), it may be formed solely by the recesses (34).

Valve sub (35) comprises valve sub housing (24), valve body (25), and check valves (26) and (27). Check valve (26) is seated against valve body (25) at seat (32) by the force of gravity. Check valve (27) is seated against seat (33) by spring (28). Valve body (25), check valves (26) and (27) and spring (28) are held in place in valve sub housing (24) by the bottom end of lower mandrel (23), which is threadedly attached to the valve sub housing. Check valves (26) and (27) are both normally closed. Spring (28) is chosen to apply enough force to valve (27) to prevent fluid in the passageway through the invention from seeping through the valve when the invention is removed from the casing and there is no fluid pressure on the bottom of the valve. When either of the check valves is open, there is fluid communication between the exterior of the valve sub housing (24) through ports (29) to passageway (37) which extends generally along the axis of the invention.

An upper mandrel (17) is threadedly connected to the top of mandrel connector sub (18). A top sub (16) is likewise threadedly connected to the top of upper mandrel (17). The top sub (16) is conveniently threaded at its upper end to accept drill pipe (15) of the appropriate dimensions. The connection of the invention to the drilling rig is thereby standardized with other commonly used drilling tools. The invention is connected to the drilling fluid pump (not shown), completing passageway (37) from ports (29) in the valve sub housing (24) to the pump (assuming either of the check valves is open). The invention is also connected to the drilling motor (not shown), which is in turn connected to elevators (41) and slips (42).

II. Operation

The invention has two modes of operation: simple filling; and circulating. In the filling mode, shown in FIG. 1, the valve sub (35) and part of the lower mandrel (23) is inserted into the casing. Fluid is then pumped through the invention and the pumping force (in addition to the gravitational force on the fluid in the passageway) causes check valve (27) to open and allow fluid to flow into the casing. When the pumping force is removed, the check valve (27) closes and fluid ceases to flow through the invention.

In the circulating mode, the invention is lowered so that the sealing section is within the casing as shown in FIG. 2. Sealing element (19) has sidewalls which have an outer diameter exceeding the inner diameter of the casing and which are tapered at a shallow angle from vertical (see FIG. 1) so that the sealing element is relatively easily compressed as it is inserted into the casing. As the invention is lowered into the casing, elevators (41) and slips (42) are moved downward on the outer surface of the casing.

With the invention thus fully inserted into the casing, fluid is pumped through the invention, opening check valve (27) and flowing into the interior of the casing, which is now sealed by sealing section (2). As more fluid is pumped into the casing, the pressure inside the casing increases. As a result, the force applied to the lower surfaces of the invention increases. At the same time, however, the fluid is allowed to pass through the passageway formed by ports (21), recesses (34) and cavity (36) so that the same fluid pressure which tends to force the invention outward also forces the sealing element against the wall of the casing, providing greater sealing and resistance to movement of the invention. The sealing element is thus self-energizing. Any upward movement of the invention which does occur forces elevators (41) upward, tightening slips (42) which thus provide greater resistance to movement. With the invention secured in place, the fluid pressure forces the fluid to circulate downward and through the casing, as intended.

When sufficient circulation has been achieved, the pumping of the fluid through the invention is halted and, with the reduction of the pumping force, check valve (27) closes. Any remaining pressure differential in the casing (above the pressure in the passageway (37)) causes check valve (26) to open and equalize the pressures in the casing and in the invention. Thus, by measuring the fluid pressure in the invention, the pressure in the casing can be determined and appropriate safety measures can be taken to prevent removal of the invention when casing pressure is too high.

After repeated use, the extreme pressures to which the invention is subjected may cause the sealing element to extrude somewhat, so that the upper portion of the sealing element begins to conform to the shape of the gap between the mandrel connector sub (18) and the casing. While such extrusion may cause seals in prior art tools to be discarded, the sealing element of the invention can be removed, reversed (turned upside-down), and returned to its position in the sealing section for further use. The removal of the sealing element is easily accomplished by removal of the valve sub (35) and retaining ring (22). The sealing element can then be reversed or replaced, as necessary.

What is claimed:

1. A filling and circulating tool for use in casing operations in subterranean wellbores comprising:

(a) a body adapted for disposing within a casing string having an upper and lower end, said body forming a fluid passageway therethrough, said body being adapted for circulating a fluid through said fluid passageway of said body into said casing string; and (b) a blocking mechanism connected about said body in a manner such that when said tool is in a circulating position wherein said blocking mechanism is frictionally fitted within said upper end of said casing string said blocking mechanism prevents said fluid circulated through said body into said casing string from passing through said upper end of said casing string thereby expelling said fluid through said lower end of said casting string, and when said tool is in a filling position wherein said blocking mechanism is not located within said casing string said fluid circulate through said body and into said casing string and is expelled through said upper end of said casing string.

2. The filling and circulating tool of claim 1 wherein said blocking mechanism comprises an elastomeric sealing element adapted to frictionally fit within said casing, said sealing element being generally torroidal in shape and having an inner face and an outer face, said inner face being in fluid communication with an interior of said casing string in a manner such that when said tool is in said circulating position fluid pressure within said casing string forces said sealing element generally radially outward from said body against said casing string.

3. The filling and circulating tool of claim 2 wherein said sealing element is substantially symmetric about a plane perpendicular to the axis of said seal.

4. The filling and circulating tool of claim 3 further comprising a first valve disposed near a lower end of said fluid passageway formed by said body, said first valve permitting said fluid in said fluid passageway to flow therethrough into said casing string and preventing said fluid within said casing string from flowing therethrough into said fluid passageway, said first valve being biased in a closed position by a force sufficient to prevent a volume of fluid in said passageway from flowing through said first valve when no external force is acting on said volume of fluid.

5. The filling and circulating tool of claim 4 further comprising a second valve disposed near a lower end of said fluid passageway formed by said body, said second valve preventing fluid from passing therethrough out of said passageway, said second valve allowing said fluid within said casting string to flow therethrough into said fluid passageway.

6. The filling and circulating tool of claim 3 wherein said outer face of said sealing element has an upper half and a lower half, each said half being a substantially conical section, said halves having their greater diameters at said plane of symmetry of said sealing element so that said outer face of said seal is tapered with respect to the wall of said casing string for frictionally inserting into said casting string.

7. A method for blocking the upper end of a casing string during casing running operations so that fluid injected into the casing string is circulated through said casing string and out of the lower end of the casing string comprising the steps of:

a) placing in a casing string an elastomeric sealing element having an outer face is directed radially contacting a wall of said casing string and an inner face which is directed radially inward from said wall of said casing string, said inner face being in fluid communication with an interior of said casing string; and (b) injecting a fluid into said casing string, thereby applying fluid pressure to said inner face of said elastomeric sealing element further forcing said sealing element radially outward against said wall of said casting string.

* * * * *

UNITED STATES PATENT AND TRADEMARK OFFICE

CERTIFICATE OF CORRECTION

PATENT NO. : 5,584,343

DATED : December 17, 1996

INVENTOR(S) : Malcolm G. Coone

It is certified that error appears in the above-identified patent and that said Letters Patent is hereby corrected as shown below:

In the ABSTRACT:

Line 1: "apparths" should be "apparatus"
Line 11: "explled" should be "expelled"

Signed and Sealed this

Second Day of December, 1997

*Attest:*

Bruce Lehman

BRUCE LEHMAN

*Attesting Officer*

*Commissioner of Patents and Trademarks*